US006488106B1

(12) United States Patent
Dourfaye

(10) Patent No.: US 6,488,106 B1
(45) Date of Patent: Dec. 3, 2002

(54) SUPERABRASIVE CUTTING ELEMENT

(75) Inventor: Alfazazi Dourfaye, Paris (FR)

(73) Assignee: Varel International, Inc., Carrollton, TX (US)

( * ) Notice: Subject to any disclaimer, the term of this patent is extended or adjusted under 35 U.S.C. 154(b) by 24 days.

(21) Appl. No.: 09/777,295

(22) Filed: Feb. 5, 2001

(51) Int. Cl.[7] ..... E21B 10/36
(52) U.S. Cl. ..... 175/428; 175/432; 175/434
(58) Field of Search ..... 175/327, 425, 175/426, 428, 432, 434

(56) References Cited

U.S. PATENT DOCUMENTS

| | | | | |
|---|---|---|---|---|
| 4,592,433 | A | 6/1986 | Dennis | 175/329 |
| 4,604,106 | A | 8/1986 | Hall et al. | 51/293 |
| 4,784,023 | A | 11/1988 | Dennis | 76/108 A |
| 4,861,350 | A | 8/1989 | Phaal et al. | 51/307 |
| 4,954,139 | A | 9/1990 | Cerutti | 51/293 |
| 4,972,637 | A | 11/1990 | Dyer | 51/295 |
| 4,984,642 | A | 1/1991 | Renard et al. | 175/329 |

(List continued on next page.)

FOREIGN PATENT DOCUMENTS

| | | | | |
|---|---|---|---|---|
| EP | 0 638 383 | A1 | 2/1995 | B23B/27/14 |
| EP | 0 655 549 | A1 | 5/1995 | E21B/10/56 |
| EP | 0 687 797 | A1 | 12/1995 | E21B/10/56 |
| EP | 0 688 937 | A1 | 12/1995 | E21B/10/56 |
| EP | 0 738 823 | A2 | 10/1996 | E21B/10/56 |
| EP | 0 764 760 | A2 | 3/1997 | E21B/10/56 |
| GB | 2 275 068 | A | 8/1994 | E21B/10/46 |
| GB | 2 283 772 | A | 5/1995 | E21B/10/46 |
| GB | 2 283 773 | A | 5/1995 | E21B/10/46 |
| GB | 2 305 449 | A | 9/1997 | E21B/10/56 |
| GB | 2 327 690 | A | 2/1999 | E21B/10/56 |

*Primary Examiner*—Roger Schoeppel
(74) *Attorney, Agent, or Firm*—Baker Botts L.L.P.

(57) ABSTRACT

A cutting element for an earth boring bit comprises a cutting compact of a superabrasive material layer bonded to a supporting substrate. The superabrasive material layer has a pattern of radially extending ribs, the ribs extending from the peripheral surface of the layer, and a second pattern of circular ribs radially spaced from the peripheral surface and intersecting the first pattern of radially extending ribs. The supporting substrate comprises a first pattern of radially extending grooves for mating with the first pattern of radially extending ribs. In addition, the supporting substrate comprises a second pattern of circular grooves for mating with the first pattern of circular ribs. The interface between the substrate and the superabrasive material has a dome-shaped configuration.

20 Claims, 5 Drawing Sheets

U.S. PATENT DOCUMENTS 5,007,207 A 4/1991 Phaal ..... 51/204
5,011,515 A 4/1991 Frushour ..... 51/307
5,037,451 A 8/1991 Burnand et al. ..... 51/293
5,120,327 A 6/1992 Dennis ..... 51/293
5,217,081 A 6/1993 Waldenström et al. ... 175/420.2
5,351,772 A 10/1994 Smith ..... 175/428
5,355,969 A 10/1994 Hardy et al. ..... 175/432
5,435,403 A 7/1995 Tibbitts ..... 175/432
5,460,233 A 10/1995 Meany et al. ..... 175/428
5,469,927 A 11/1995 Griffin ..... 175/432
5,484,330 A 1/1996 Flood et al. ..... 451/540
5,486,137 A 1/1996 Flood et al. ..... 451/540
5,494,477 A 2/1996 Flood et al. ..... 451/540
5,564,511 A 10/1996 Frushour ..... 175/431
5,566,779 A 10/1996 Dennis ..... 175/426
5,590,728 A 1/1997 Matthias et al. ..... 175/432
5,590,729 A 1/1997 Cooley et al. ..... 175/432
5,605,199 A 2/1997 Newton ..... 175/432
5,611,469 A 3/1997 Matthias ..... 407/118
5,617,928 A 4/1997 Matthias et al. ..... 175/432
5,622,233 A 4/1997 Griffin ..... 175/432
5,645,617 A 7/1997 Frushour ..... 51/309
5,647,449 A 7/1997 Dennis ..... 175/434
5,709,279 A 1/1998 Dennis ..... 175/430
5,788,001 A 8/1998 Matthias et al. ..... 175/432
5,816,347 A 10/1998 Dennis et al. ..... 175/432
5,862,873 A 1/1999 Matthias et al. ..... 175/432
5,887,580 A 3/1999 Eyre ..... 125/36
5,888,619 A 3/1999 Griffin ..... 428/172
5,906,246 A 5/1999 Mensa-Wilmot et al. ... 175/432
5,928,071 A 7/1999 Devlin ..... 451/547
5,957,228 A 9/1999 Yorston et al. ..... 175/430
5,971,087 A 10/1999 Chaves ..... 175/432
6,009,963 A 1/2000 Chaves et al. ..... 175/432
6,011,232 A 1/2000 Matthias ..... 219/69.17
6,026,919 A 2/2000 Thigpen et al. ..... 175/432
6,029,760 A 2/2000 Hall ..... 175/432
6,041,875 A 3/2000 Rai et al. ..... 175/432
6,077,591 A 6/2000 Griffin ..... 428/172
6,082,474 A 7/2000 Matthias ..... 175/432
6,202,771 B1 3/2001 Scott et al. ..... 175/432
6,315,652 B1 11/2001 Snyder et al. ..... 451/540

SUPERABRASIVE CUTTING ELEMENT

TECHNICAL FIELD OF THE INVENTION

This invention relates to a cutting element for an earth boring bit, and more particularly to a cutting element having improved stress distribution between a substrate and a superabrasive cutting compact.

BACKGROUND OF THE INVENTION

Cutting compacts used as cutting elements in rotary drill bit construction typically comprise a layer of synthetic diamonds, conventionally in the form of polycrystalline diamond. Polycrystalline diamond compact cutting elements, commonly known as PDC's, have been commercially available for many years. Although there has been some use of PDC's as a self-supporting layer, the more recent utilization of the polycrystalline diamond compact is in the form a substantially planar diamond layer bonded during formation to a supporting substrate.

Previous uses of the PDC have demonstrated that these compacts are resistant to abrasion and erosion, although there are several identified disadvantages. polycrystalline diamond and tungsten carbide, main components of a PDC, are brittle materials that easily fracture on impact. Another recognized disadvantage of the PDC is the different coefficient of thermal expansion between tungsten carbide and polycrystalline diamond. As a result of this different coefficient of thermal expansion, residual stresses have been identified and are a result of the greater contraction of tungsten carbide over synthetic diamond during a cooling phase. This thermally induced stress between the various components of the PDC results in a reduction in the bond strength between the two components.

During use of a PDC, it has been observed that impact forces relieve the residual sheer stresses resulting in fractures in the compact. The result of this fracturing is that the diamond layer spalls and/or delaminates resulting in a separation and loss of the diamond layer resulting in a failure of the PDC.

Heretofore, a common problem with cutting elements of superabrasive compacts bonded to a substrate is spalling and delamination of the superabrasive layer from the substrate. Spalling and delamination result from subjecting the cutting element to extreme temperatures and heavy stress load fluctuation when a drill bit is in use down a bore hole. During operation at extremely high temperatures, thermally induced stresses have been identified at the interface between the superabrasive cutting compact and the supporting substrate, the magnitude of the stresses being a function of the disparity in the thermal expansion coefficients of adjacent materials.

There are numerous patents granted directed to various attempts made to limit the effects of thermal induced stress by modifying the geometry of the interface between the diamond and the tungsten carbide. As illustrated by a review of earlier issued patents, the interface modification many times replaces a planar interface with an irregular, non-planar interface geometry. Many of the early attempts to solve the stress related disadvantages of the PDC claim as an advantage the redistribution of residual stresses. A redistribution of residual stresses does allow an increase in the diamond thickness thereby resulting in an increase in bit life. The non-linear planar interface between the diamond and the tungsten carbide substrate results in an enhanced mechanical interlocking and improved stability and performance of the cutting element and therefore translates into longer bit life.

While cutting elements utilizing the superabrasive cutting compacts employed in rotary drill bits for earth boring have achieved major advances in obtainable rate of penetration at economically viable costs, the interface between the superabrasive cutting compact and the supporting substrate leaves something to be desired. As a result, considerable activity has been directed toward attempts to improve the bond between the superabrasive cutting compact and the supporting substrate by configuring the rear face of the cutting compact so as to provide a degree of mechanical interlocking between the cutting compact and the supporting substrate. Several United States patents directed to solutions for this problem have been granted including U.S. Pat. Nos. 5,617,928; 4,784,023 and 5,351,772, to identify only a few, describe various techniques for improving the bond between the superabrasive cutting compact and the supporting substrate.

The present invention relates to improvements in the interface between the superabrasive cutting compact and the supporting substrate.

SUMMARY OF THE INVENTION

According to the invention there is provided a superabrasive cutting compact integral with a substrate to form a cutting element. The cutting compact comprises a pattern of radially extending ribs where the ribs extend from in proximity to a peripheral edge of the compact. A circular shaped pattern of circular ribs radially spaced from the peripheral edge of the compact intersect the pattern of radially extending ribs. The substrate supporting the cutting compact comprises a pattern of radially extending grooves for mating with the pattern of radially extending ribs. The substrate also comprises a pattern of circular grooves for mating with the pattern of circular ribs of the cutting compact.

The ribs of the cutting compact and the grooves of the substrate have an expanding width dimension from one circumferential segment of a peripheral edge of the cutting element to the opposite circumferential segment. Further, in accordance with this alternate embodiment, the circular pattern of ribs and the circular pattern of grooves comprise segments of concentric circles spaced from the peripheral edge. The ribs and grooves can have different widths and depths.

In another embodiment of the invention, the substrate surface comprises a convex surface and the mating surface of the cutting compact comprises a concave surface.

Alternatively, the cutting element comprises a cylinder with the cutting compact fixed perpendicular to the axis of the cylinder or the superabrasive cutting compact is affixed directly to a stud insert for use with a rotary drill bit.

A technical advantage of the present invention is a cutting element having improved stress distribution between a superabrasive material cutting compact and a supporting substrate resulting in enhanced performance of a cutting element as part of a rotary drill bit. An additional technical advantage of the present invention is providing an improved bond between the superabrasive material cutting compact and the substrate surface affixed thereto.

DETAILED DESCRIPTION OF THE INVENTION

Figure 1A:
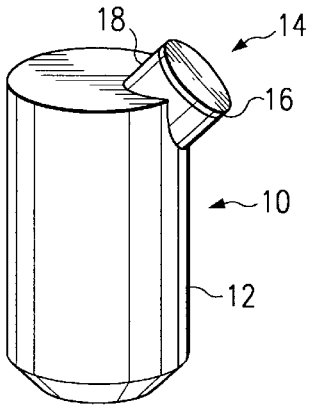
FIGS. 1A and 1B are side elevational views of a cutting element in accordance with the present invention supported on an insert typically utilized in a rotary bit.
Figure 1B:
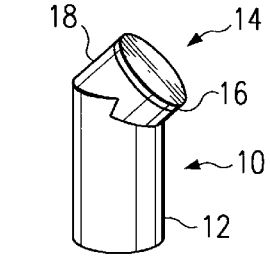

Referring to FIGS. 1A and 1B, there is illustrated a bit insert 10, that is, an insert for a rotary drag bit, comprises a cylindrical body 12 and a disk shaped cutting element 14 bonded thereto. The bit insert 10 forms a part of a cutter assembly of a rotary drag bit and in accordance with conventional manufacturing techniques the cylindrical body 12 is positioned in a socket in the body of the rotary drag bit. The cutting element 14 has a circular tablet-like configuration comprising a planar compact layer 16 of superabrasive material, usually polycrystalline diamond, bonded to a substrate 18 normally of cemented tungsten carbide. The mating surfaces of the diamond compact layer 16 and the supporting substrate 18 are bonded together typically by braze bonding or LS bonding. The diamond compact layer 16 can be obtained by HPHT process from synthetic diamond powder.

Figure 2:
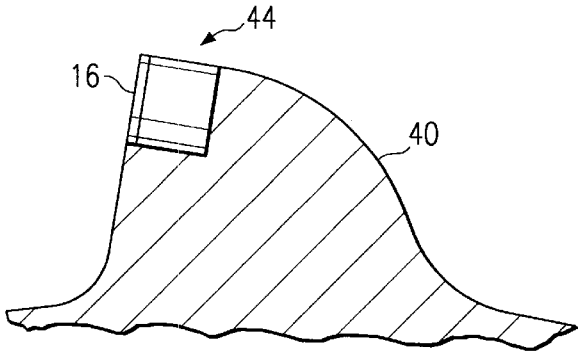
FIG. 2 is a side pictorial illustration of a typical cutter assembly incorporating a right cylinder cutting element according to the invention.
Figure 3:
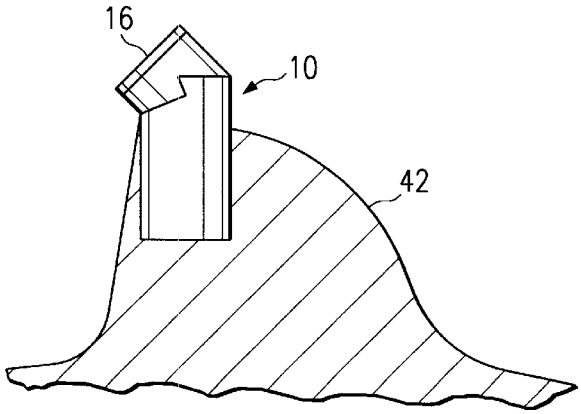
FIG. 3 is also a pictorial illustration of a cutter assembly incorporating the cutting element of FIG. 1B.

Referring to FIGS. 2 and 3, the cutting element 10 of FIGS. 1A and 1B may be attached to various types of carrier elements or structure supports 40 and 42. FIG. 2 is an illustration of a stud cutter 40 with a right cylinder cutting element 44 attached thereto in a conventional socket. The cutting element 44 is oriented such that the diamond compact layer 16 is positioned such that the face thereof engages the rock formation to be cut. FIG. 3 illustrates the bit insert 10 of FIG. 1B inserted into a socket such as by brazing. Again, the diamond compact layer 16 is positioned to engage the rock formation to be cut.

Figure 4:
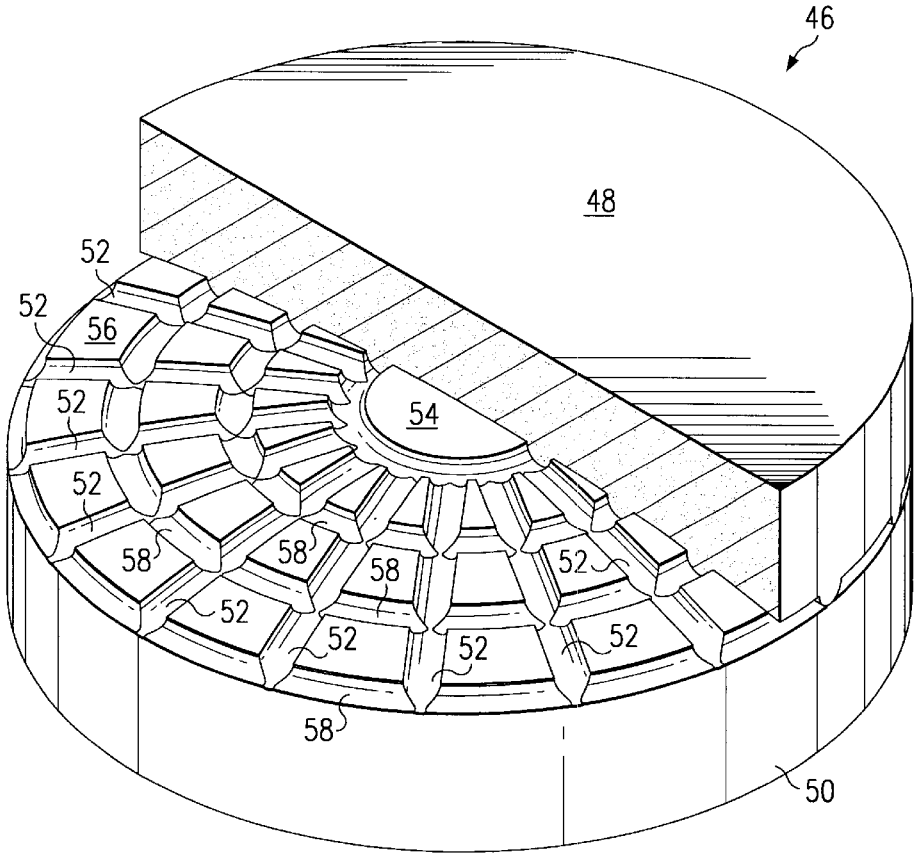
FIG. 4 is a pictorial illustration, partially in section, illustrating the interface layout of radial and concentric grooves between a substrate material and a compact of super hard material.

One form of the disk shaped cutting element 14 for a drill bit in accordance with the present invention is illustrated in FIG. 4. In this embodiment, the cutting element 14 is in the form of a circular tablet 46 and comprises a diamond compact layer 48 of super hard material, such as PDC, bonded in a high pressure, high temperature press to a supporting substrate 50 of less hard material, such as cemented tungsten carbide. However, other suitable materials may be used for the diamond compact layer 48 and the supporting substrate 50. The methods of forming such cutting elements are well known and no further description is deemed necessary.

As illustrated in FIG. 4, the supporting substrate 50 is preformed with radially extending grooves 52 having a first end and a center disk 54 and a second end extending to the periphery 56 of the substrate 50. Further, the substrate 50 includes concentric circular grooves 58, four concentric circular grooves illustrated in FIG. 4 with the inner circular groove 58 at the center disk 54 and the remaining circular disks spaced therefrom. As illustrated, the radially extending grooves 52 are equally dimensioned along the length thereof. However, it is within the scope of the invention to include radially extending grooves having expanded groove width along the length thereof. Also as illustrated in FIG. 4, the concentric circular grooves 58 are all of the same dimension. However, it is within the scope of the invention that the radially extending grooves 52 and concentric circular grooves 58 may have different dimensions in width and depth.

Figure 7:
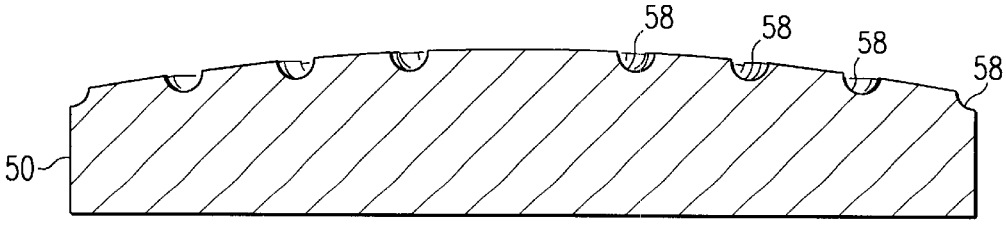
FIG. 7 is a section view of the substrate component for the cutting elements of FIGS. 5 and 6.

Referring to FIG. 7, the supporting substrate 50 has a convex surface configuration and the mating surface of the superabrasive material 48 has a concave surface configuration. The dome-shaped interface, by virtue of its geometry, increases the volume of super hard material available for abrasive formation cutting. In addition, the dome shaped interface, in combination with the radially extending grooves 52 and the concentric circle grooves 58, minimizes spalling and delamination of the cutting element. The dome-shaped interface provides improvement in spalling and delamination as a result of reduction in sheer stress and compressive stress as applied to the interface during use of the cutting element. Better control over sheer stress and compressive stress is also achieved by variations in the width and depth of the radially extending grooves and the concentric circular grooves. Additionally, the dome shaped interface allows a thick super hard layer to be provided toward the perimeter of the element, thereby increasing durability of the element during cutting of a formation.

Figure 5:
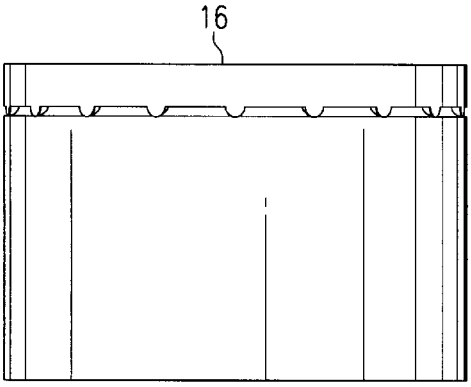
FIG. 5 is a side elevational view of the cutting element of FIG. 4 illustrating the depth of the hard facing material in one embodiment of the present invention.
Figure 6:
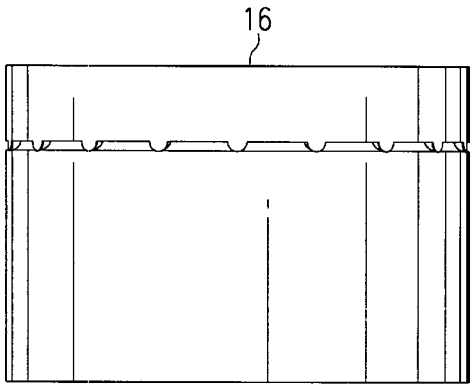
FIG. 6 is a side elevational view of a cutting element in accordance with the present invention for a second depth of super hard material in accordance with the present invention.

Referring to FIGS. 5 and 6, there is illustrated two embodiments of the present invention with the dome-shaped interface of FIG. 7 and the radially extending grooves 52 and concentric circle grooves 58 as illustrated in FIG. 4. In the embodiment of FIG. 5, the planar compact layer 16 has a thickness of 0.080 inches (2 millimeters) and in the embodiment of FIG. 6 the planar compact layer 16 has a thickness of 0.140 inches (3.5 millimeters).

With reference to FIGS. 4, 5, 6 and 7, the dome-shaped interface with the radially extending grooves 52 and the concentric circular grooves 58 minimize tensile stresses in the diamond. These stresses are caused by differences in coefficients of thermal expansion between the diamond compact and the tungsten carbide substrate. This type of stress is identified in the literature including earlier granted patents as residual stress. It is these residual stresses that can lead to stress fractures exhibited as spalling and microchipping in the area of the cutting face and perimeter of the diamond compact. A cutting element having a flat interface between the diamond compact (layer 16) and the substrate exhibits area of high stress just above the interface in the diamond compact. This is where a cutter element with a flat interface is most likely to spall or delaminate.

However, an interface between the diamond compact (layer 16) and the substrate in accordance with the present invention such as illustrated in FIGS. 4 through 7 reduces the tensile stress, thereby reducing the potential for spalling and delamination.

Figure 8:
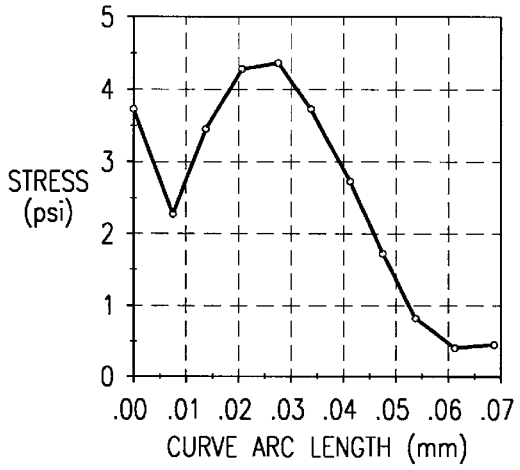
FIG. 8 is a plot of the potential stress on the outer diameter of the diamond compact for the cutting element of FIG. 5.
Figure 9:
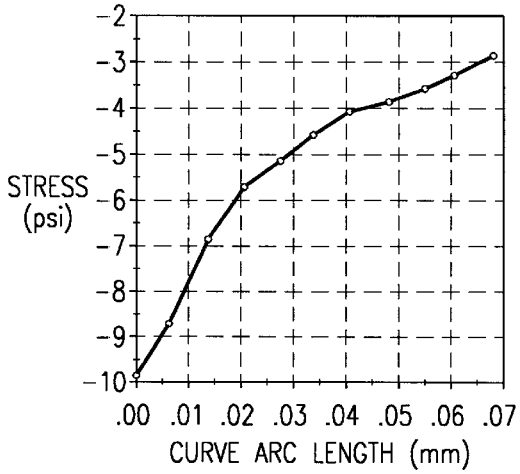
FIG. 9 is a plot of compressive stresses for the cutting element of FIG. 5.

Referring to FIGS. 8 and 9, there is plotted the tensile stress and compressive stress for the cutting element of FIG. 5 having a diamond compact (layer 16) 0.080 inches (2 millimeters) thick. The interface of the cutting element has a dome-shaped configuration wherein the dome has a radius of 1.90 inches (48 millimeters). The dome-shaped interface reduces the high tensile stress that is normally observable on the outer diameter of the diamond compact approximately 0.030 inches above the interface. As illustrated in FIG. 8, the maximum tensile stress for the tested specimen was 45,000 psi.

Referring to FIG. 9, the cutting element of FIG. 5 exhibits a large region of compressive stress. These compressive stresses reduce the tendency of the cutter to spall and help deflect cracks that may cause massive fractures in the diamond compact. The minimum compressive stress for the cutting element of FIG. 5 is 30,000 psi.

Figure 10:
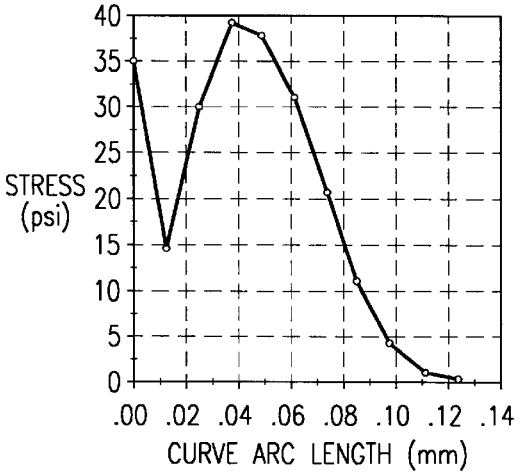
FIG. 10 is a plot of tensile stress for the thicker diamond compact of the cutting element of FIG. 6.
Figure 11:
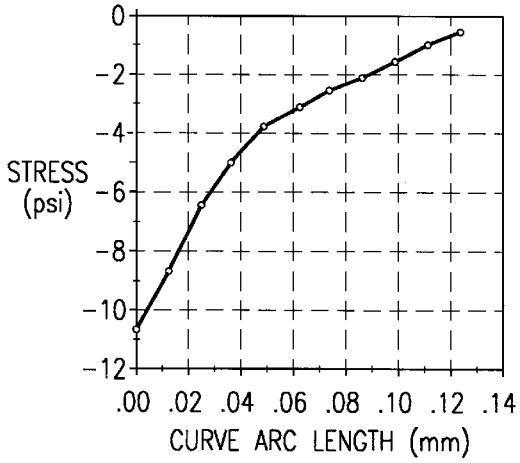
FIG. 11 is a plot of compressive stress in the diamond compact of the interface for the cutting element as illustrated in FIG. 6.

Referring to FIGS. 10 and 11, there is illustrated tensile test measurements and compressive stress measurements for the cutting element of FIG. 6 having a diamond compact (layer 16) of 0.140 inches (3.5 millimeters) thickness. Again, the interface between the diamond compact and the substrate has a dome-shaped configuration wherein the radius of the dome is 1.0 inches (25 millimeters). This interface has more of a dome shape than the interface of FIG. 5 to accommodate the thicker diamond compact. As illustrated in FIG. 10 the maximum tensile stress is below 40,000 psi.

Referring to FIG. 11, the cutting element of FIG. 6 has a large region of compressive stress. The compressive stress in the diamond compact (layer 16) of the cutting element of FIG. 6 is higher than the compressive stress measurements for the cutting element of FIG. 5 wherein the diamond compact (layer 16) had a thickness of 0.080 inches (2 millimeters). However, the maximum compressive stress on the top surface of the cutting element of FIG. 6 is less than the cutting element of FIG. 5. This is due to the volume of diamond material used in the diamond compact of FIG. 6. As illustrated in FIG. 11, the minimum compressive stress was less than 10,000 psi.

Finite Element Analysis (FEA) was utilized for measuring the principal stress in the cutting element of FIGS. 5 and 6. The results indicate a reduction of residual tensile stresses in the superabrasive diamond compact over a compact having a planar interface between the diamond and the supporting substrate.

Figure 12:
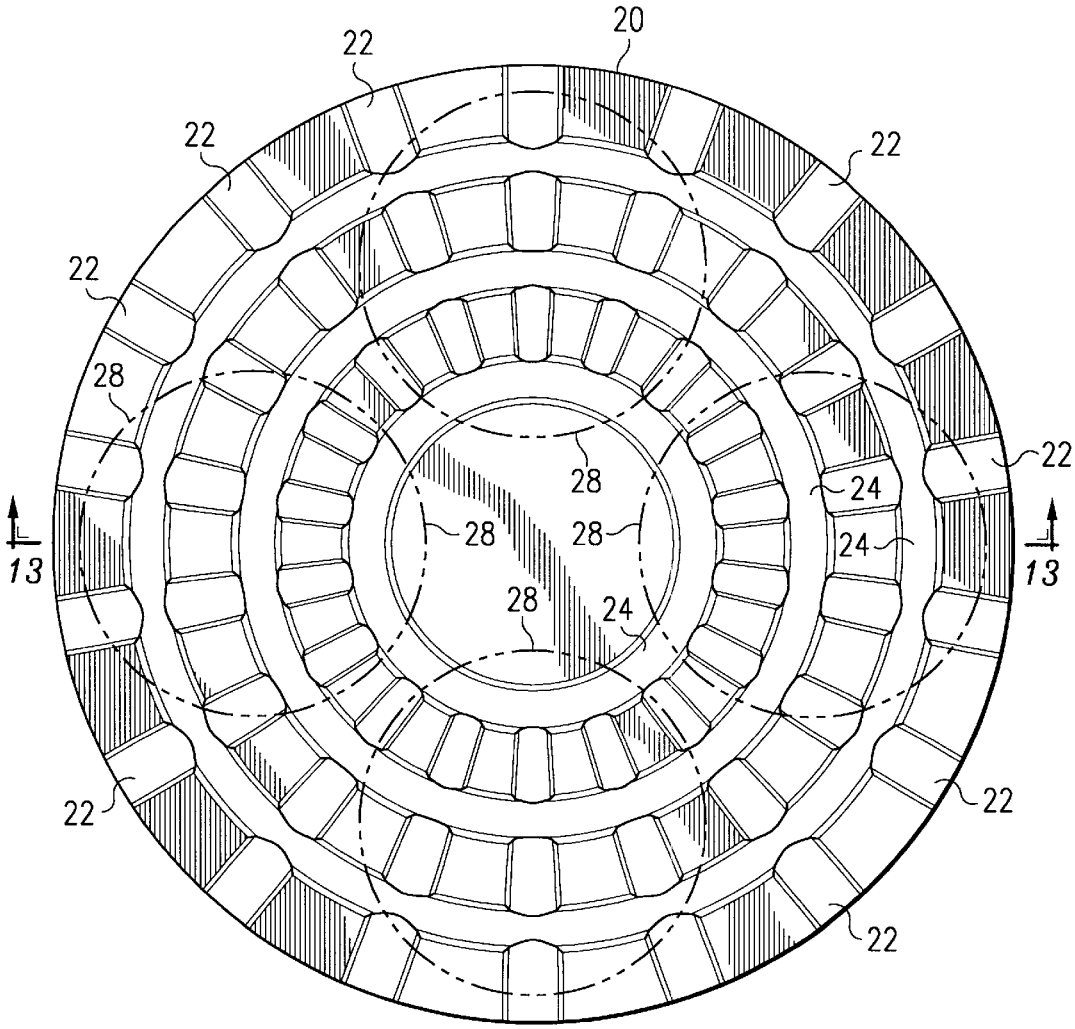
FIG. 12 is a top view of the substrate for forming a plurality of cutting elements in accordance with an alternative embodiment of the invention illustrating the interface layout of radial and concentric grooves.

Referring to FIG. 12, there is illustrated a top view of another embodiment comprising a substrate component 20 typically manufactured from cemented tungsten carbide and as illustrated is in the form of a cylinder. The substrate component 20 is preformed with radially extending grooves 22 and concentric circular grooves 24. The substrate 20 is typically formed by a molding process using conventional molding techniques.

Figure 13:
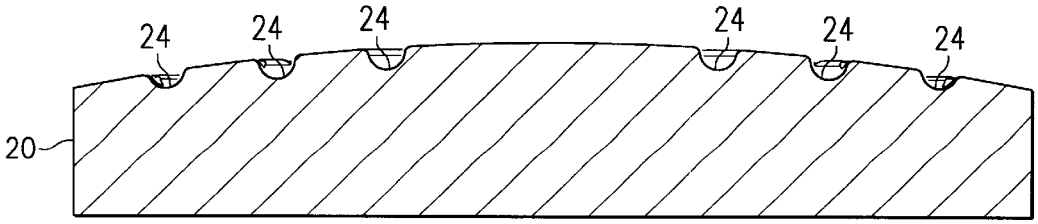
FIG. 13 is a section view of the substrate component of FIG. 12.

As illustrated in FIG. 13, a compact layer of superabrasive material, such as polycrystalline diamond, is applied to the patterned surface of the substrate component 20 such that the superabrasive material fills the radially extending grooves 22 and the concentric circular grooves 24. The assembly is then placed in a high pressure, high temperature press and is subjected to high temperatures and pressures until the superabrasive layer 26 bonds to the substrate component 20.

Upon completion of the bonding of the superabrasive layer 16 to the substrate component 20, a number of cutting elements 28 are cut from the substrate component. For example, as illustrated in FIG. 12, four cutting elements 28 are cut from the substrate component 20. This cutting produces a number of similar cutting elements 28.

Figure 14:
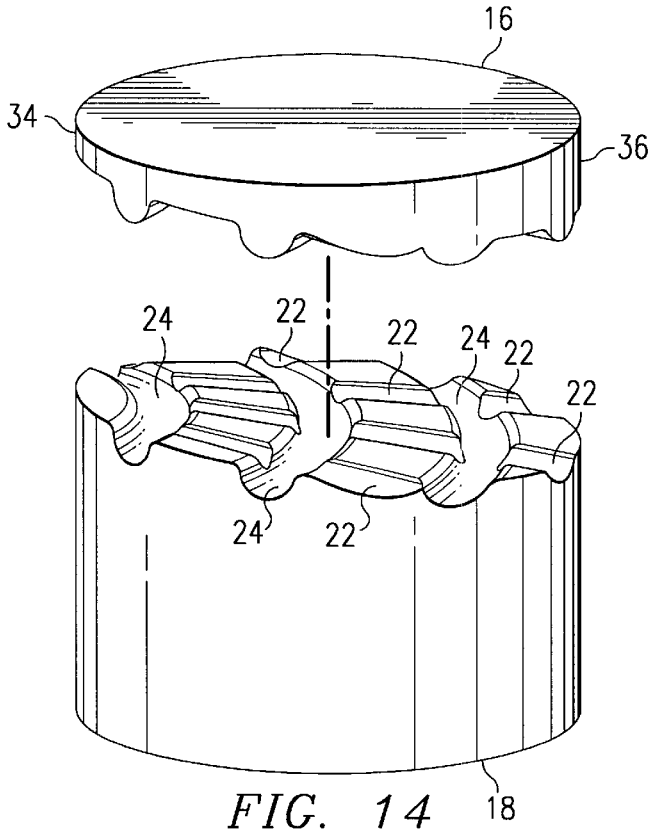
FIG. 14 is an exploded view of the superabrasive material cutting compact and the substrate of a cutting element in accordance with the alternate embodiment of the invention.
Figure 15A:
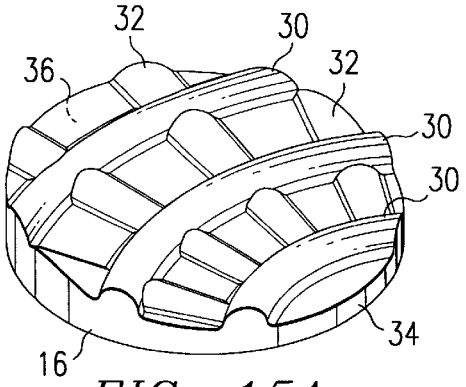
FIG. 15A is a view of the surface interface illustrating radial ribs and segments of concentric circular ribs for the cutting compact.
Figure 15B:
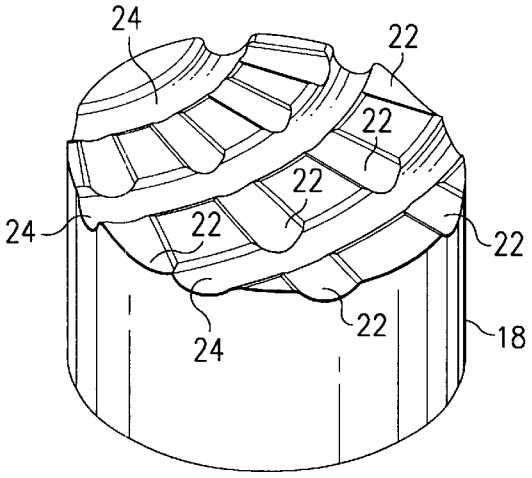
FIG. 15B is a view of the substrate for the cutting element of FIG. 14 showing the interface between the cutting compact and the substrate comprising radial grooves and segments of concentric circle grooves.

Referring to FIG. 14 and FIGS. 15A and 15B, there is illustrated a typical interface layout between the superabrasive compact layer 16 and the supporting substrate 18 for a cutting element 28. The cutting element 28 as illustrated in FIGS. 14, 15A and 15B comprises the superabrasive layer 16 bonded to the substrate 18. The interface between the superabrasive layer 16 and the supporting substrate 18 comprises a pattern of radially extending ribs 32 on the superabrasive layer 16 mating with radially extending grooves 22 on the substrate 18 as best illustrated in FIGS. 15A and 15B. In addition, the superabrasive layer 16 includes segments of concentric circular ribs 30 mating with segments of concentric circular grooves 24 as part of the substrate 18. The radially extending ribs and grooves and the segments of concentric circular ribs and grooves intersect to form an interface providing improved stress distribution between the substrate and the superabrasive material layer not previously achievable in the art of cutting compacts.

Also with reference to FIGS. 13 and 14, the patterned surface of the substrate component 20 has a convex surface configuration and the mating surface of the superabrasive material 16 has a concave surface configuration. Thus, each of the cutting elements 28 has a curved interface between the superabrasive material layer 16 and the supporting substrate 18. This curved surface interface provides a material layer having a thickness that increases smoothly from one circumferential segment of the peripheral surface 34 to the cutting edge 36 of the peripheral surface 34.

Referring to FIG. 12, the concentric grooves 24 may be of equal widths or of different widths and depths. In the case of different groove widths and depths, the width increases from the innermost circular groove to the circular groove closest to the cutting edge 36. Similarly, the radial grooves 22 are narrower towards that segment of the peripheral surface 34 most removed from the cutting edge 36. That is, the radial grooves 24 as illustrated in FIG. 12 increase in width and depth from the center of the substrate component 20.

The interface layout and the overall shapes of the cutting elements illustrated and described are by way of example only, and it will be appreciated that the interface layout according to the invention may be applied to any shape or size and form of cutting element.

Although the present invention has been described in connection with several embodiments, it will be appreciated by those skilled in the art that modifications, substitutions and additions may be made without departing from the scope of the invention as defined in the claims.

What is claimed is:

1. A cutting element for an earth boring bit wherein the cutting element comprises a cutting edge of a peripheral surface, comprising:

a superabrasive material cutting compact having a first pattern of a plurality of radially extending ribs, the ribs extending from a center to the peripheral surface of the compact, and a second pattern of a plurality of circular ribs radially spaced from the peripheral surface and intersecting the first pattern of radially extending ribs; and a substrate supporting the cutting compact, the substrate comprising a first pattern of a plurality of radially extending grooves for mating with the first pattern of a plurality of radially extending ribs, and a second pattern of a plurality of circular grooves for mating with the second pattern of a plurality of circular ribs.

2. The cutting element for an earth boring bit as in claim 1, wherein the first pattern of radially extending ribs and the first pattern of radially extending grooves comprises a width dimension that changes in the radial direction.

3. The cutting element for an earth boring bit as in claim 2, wherein the width dimension of the first pattern of ribs and the first pattern of grooves increases in the radial direction from the center toward the peripheral surface.

4. The cutting element for an earth boring bit as in claim 1, wherein the thickness of the cutting compact increases to a maximum toward the peripheral surface.

5. The cutting element for an earth boring bit as in claim 4, wherein the thickness of the cutting compact varies as a concave surface having a maximum dimension toward the cutting edge.

6. The cutting element for an earth boring bit as in claim 1, wherein the second pattern of a plurality of circular ribs and the second pattern of a plurality of circular grooves comprise mating segments of concentric circles.

7. A cutting element for an earth boring bit, wherein the cutting element comprises a peripheral surface having a cutting edge, comprising:

a diamond cutting compact layer having a fan shaped pattern of a plurality of ribs, the ribs extending from one part of the peripheral surface to a second part of the peripheral surface of the compact, and a concentric circle pattern of a plurality of circular ribs radially spaced from the peripheral surface and intersecting the pattern of the radially extending ribs; and a substrate supporting the cutting compact, the substrate comprising a fan shaped pattern of a plurality of grooves for mating with the fan shaped pattern of the plurality of ribs, and a concentric circle pattern of a plurality of circular grooves for mating with the circular pattern of a plurality of circular ribs.

8. The cutting element for an earth boring bit as in claim 7, wherein the fan shaped pattern of ribs and the fan shaped pattern of grooves comprise a pattern of expanding width ribs and mating grooves.

9. The cutting element for an earth boring bit as in claim 8, wherein the concentric circle pattern of ribs and the concentric circular pattern of grooves comprise segments of concentric circles.

10. The cutting element for an earth boring bit as in claim 7, wherein the thickness of the cutting compact increases to a maximum toward the cutting edge.

11. The cutting element for an earth boring bit as in claim 10, wherein the thickness of the cutting compact varies as a segment of a concave surface increasing to a maximum toward the cutting edge.

12. A cutting element for an earth boring bit, comprising:

a cutting compact having a cutting edge at a peripheral surface; and a substrate supporting the cutting compact at an interface therebetween, wherein the interface between the cutting compact and the substrate comprises a pattern of a plurality of radially extending ribs mating with a pattern of a plurality of radially extending grooves, the ribs extending from a center of the interface to the peripheral surface of the compact, and a pattern of a plurality of circular ribs radially spaced from the peripheral surface and mating with a pattern of a plurality of circular grooves.

13. The cutting element for an earth boring bit as in claim 12, wherein the interface has a concave surface having a maximum dimension toward the cutting edge.

14. The cutting element for an earth boring bit as in claim 12, wherein the plurality of circular ribs and circular grooves comprise segments of concentric circles.

15. The cutting element for an earth boring bit as in claim 12, wherein the plurality of circular ribs and circular grooves comprises concentric circles intersecting the pattern of a plurality of radially extending ribs and radially extending grooves.

16. A cutting element for an earth boring bit, comprising:

a cutting compact having a cutting edge of a peripheral surface; and a substrate supporting the cutting compact at an interface therebetween, wherein the interface between the cutting compact and the substrate comprises a fan shaped pattern of a plurality of ribs mating with a fan shaped pattern of a plurality of grooves, the ribs and grooves extending from one part of the interface to a second part of the interface, and a concentric circle pattern of a plurality of circular ribs mating with a concentric circle pattern of a plurality of circular grooves spaced from the peripheral surface of the cutting compact.

17. The cutting element for an earth boring bit as in claim 16, wherein the interface has a concave surface having a maximum dimension toward the cutting edge.

18. The cutting element for an earth boring bit as in claim 16, wherein the plurality of circular ribs and circular grooves comprise segments of concentric circles.

19. The cutting element for an earth boring bit as in claim 16, wherein the plurality of circular ribs and circular grooves comprises concentric circles intersecting the fan shaped pattern of a plurality of radially extending ribs and radially extending grooves.

20. The cutting element for an earth boring bit as in claim 16 wherein the concentric circle pattern of ribs and the concentric circle pattern of grooves comprise segments of concentric circles.

* * * * *